US006486786B2

(12) United States Patent
Chuang

(10) Patent No.: US 6,486,786 B2
(45) **Date of Patent: *Nov. 26, 2002**

(54) WATER-MONITORING APPARATUS WITH ANCHOR

(75) Inventor: Hsu-Chen Chuang, Taipei (TW)

(73) Assignee: Hycom Instruments Corp., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/989,855

(22) Filed: Nov. 20, 2001

(65) Prior Publication Data

US 2002/0063628 A1 May 30, 2002

(30) Foreign Application Priority Data

Nov. 24, 2000 (TW) ..... 89220683 U

(51) Int. Cl.[7] ..... G08B 21/00

(52) U.S. Cl. ..... 340/623; 340/521; 340/539; 73/53.01

(58) Field of Search ..... 340/623, 521, 340/539; 73/53.01, 170

(56) References Cited

U.S. PATENT DOCUMENTS 4,557,608 A * 12/1985 Carver ..... 374/170
4,922,226 A * 5/1990 Hsieh et al. ..... 340/521
6,131,659 A * 7/1998 Johnson ..... 166/250.05
6,175,809 B1 * 2/1999 Naville ..... 702/14
6,185,988 B1 * 4/2000 Baxter, Jr. ..... 73/53.01

* cited by examiner

*Primary Examiner*—Daniel J. Wu
*Assistant Examiner*—Phung Nguyen
(74) *Attorney, Agent, or Firm*—Connolly Bove Lodge & Hutz LLP

(57) ABSTRACT

A water-monitoring apparatus includes an anchor for holding on to a bottom of the water, a buoy for floating on the water surface, a reel mounted on the buoy and a tension and signal cable including a lower end tied to the anchor and an upper end tied to the reel. The tension and signal cable is wound on the reel. A control device is connected with the reel. When the water level changes, the control device rotates the reel, thus adjusting a length of the tension and signal cable extending from the reel so that the buoy always float on the water surface. A shallow-water sensor is carried via the buoy for detecting a first environmental characteristic and for producing a first signal representative of the first environmental characteristic. A deep-water sensor is connected with the lower end of the tension and signal cable for detecting a second environmental characteristic and for producing a second signal representative of the second environmental characteristic. A signal relay is electrically connected with the upper end of the tension and signal cable. A transmitter transmits the first and second signals to a remote monitoring station.

20 Claims, 4 Drawing Sheets

WATER-MONITORING APPARATUS WITH ANCHOR

BACKGROUND OF INVENTION

1. Field of Invention

The present invention is directed to monitoring of water quality and, more particularly, to a water-monitoring apparatus with an anchor.

2. Related Prior Art

While developing, the world is encountering a more and more serious problem of pollution. Water pollution could be the worst among all sorts of pollution. A lot of pollutants are dumped to reservoirs and open channels from fixed sources, e.g., factories and farms, or from mobile sources, e.g., vehicles. Such pollutants may be released into water, or may be dumped on the land and then washed into the water by rain. Once introduced into the water, such pollutants inevitably increase costs in treating the water and very often harm human bodies, life stock and aquatic lives.

Therefore, it is important to solve these problems of pollution. However, before any proper measure can be taken to solve the problem of water pollution, pollutants and extent of pollution must be determined. Hence, various quality parameters of the water must be monitored.

In early days, prior to analyses, water was manually sampled. Manual sampling has always been expensive and cumbersome. Therefore, manual sampling was conducted on an irregular basis and rarely.

To achieve regular and frequent sampling, it must be done automatically. There have been installed some conventional monitoring stations into which water is automatically pumped through pipes. It is, however, found difficult to have the pipes catch up with the water level changing vigorously from season to season. When the water level becomes too low for the pipes to reach, it is impossible to pump water through the pipes.

To make sure that the water can be monitored continuously, there have been devised some water-monitoring apparatuses in which sensors are carried by means of a buoy tied to a bank or a well by means of a cable. To have the buoy float on the water when the water level is low, a sufficiently long cable is used. However, the cable allows the buoy to drift for a long distance in any direction when the water level is high. As the buoy drifts, the cable often tangles with miscellaneous objects, e.g., twigs. This could seriously affect the operation of the sensors.

To prevent the cable from. tangling with miscellaneous objects, there has been devised a length control device in which the cable is wound on a reel operatively connected with a motor. The motor can be activated to rotate the reel to adjust a length of the cable extending from the reel so that the sensors can always be immerged in water. However, the motor consumes a lot of energy.

In addition, to transmit signals from the sensors to a monitoring station, the cable is connected to the monitoring station through a signal relay including a mandrel electrically connected with the cable. The mandrel rotates together with the reel. The signal relay further includes a brush electrically connected with the monitoring station. The brush does not rotate. The mandrel is in rotational engagement with the brush, thus allowing the mandrel to rotate with respect to the brush while allowing the signals to be transmitted from the mandrel to the brush. However, friction between the mandrel and the brush interferes with the rotation of the reel and wears out the brush after serving for a period of time.

However, none of the above-mentioned water-monitoring apparatuses is suitable for use far from the bank. Hence, a water-monitoring apparatus has been devised to include a sensor carried by means of a buoy connected via a cable with an anchor or weight for holding on to a reservoir bottom or an ocean bed. Obviously, such a water-monitoring apparatus with an anchor can be employed far from the bank since it does not have to be tied to the bank. To have the buoy float on the water when the water level is high, a sufficiently long cable is used. However, when the water level is low, the cable allows the buoy to drift for a long distance in any direction. Sometimes, the buoy may drift to and get grounded on a slope by the water. This could seriously affect the operation of the sensor.

Therefore, the present invention is intended to alleviate or even obviate the afore-mentioned drawbacks that are encountered in the prior art.

SUMMARY OF INVENTION

It is an objective of the present invention to provide a water-monitoring apparatus for use far from the land.

It is another objective of the present invention to provide a water-monitoring apparatus capable of automatically tracing water level.

It is another objective of the present invention to provide a water-monitoring apparatus with a sensor-carrying cable of an automatically adjustable length.

It is another objective of the present invention to provide a water-monitoring apparatus with a sensor-carrying cable wound on a reel capable of automatic rotation for adjusting a length of the sensor-carrying cable extending from the reel.

In accordance with an aspect of the present invention, a water-monitoring apparatus includes at least one sensor carried by a buoy. The sensor is used to detect a water quality parameter. A reel is mounted on the buoy. A coil spring is used to exert a substantially constant torque on the reel. A cable is wound on the reel. The cable includes an upper end tied to the reel and a lower end tied to an anchor or weight for holding on to a water bottom.

DETAILED DESCRIPTION OF INVENTION

Figure 1:
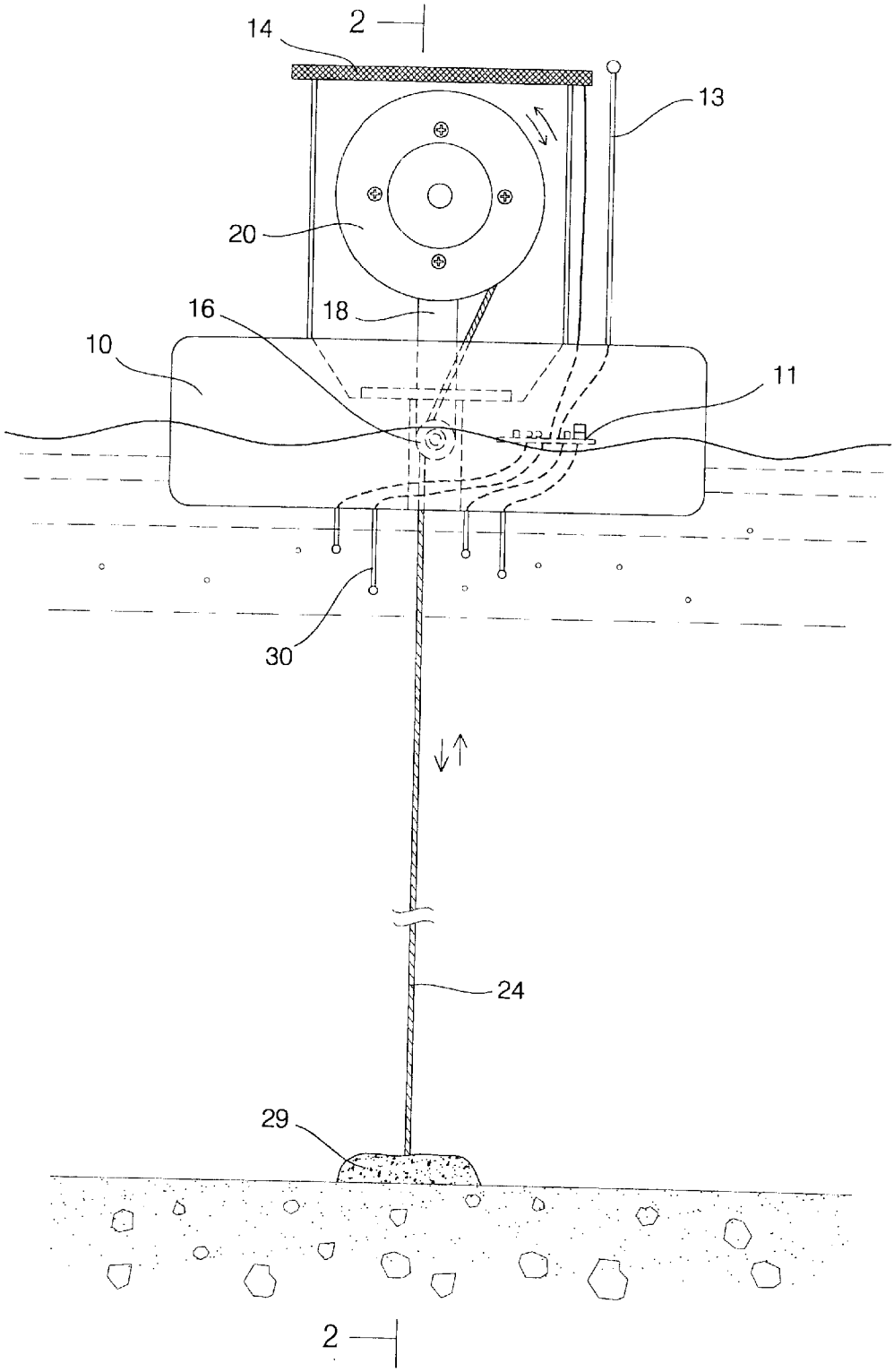
FIG. 1 is a front view of a water-monitoring apparatus in accordance with an embodiment of the present invention.

FIG. 1 shows a water-monitoring apparatus according to an embodiment of the present invention. The water-monitoring apparatus includes a buoy 10 for carrying a number of sensors 30. Each sensor 30 is at least partly immerged in the water so as to detect a water quality parameter such as pH, temperature, oxygen content, conductivity, chlorine content, turbidity, heavy metal content, etc. and to produce a signal representative of the water quality parameter.

The sensors 30 may be used to detect a same water quality parameter and in this case are positioned at different distances from the buoy 10. The sensors 30 may be used to detect different water quality parameters and in this case may be positioned at a same distance or at different distances from the buoy 10.

The sensors 30 are electrically connected with a circuit board 11. The circuit board 11 is mounted on the buoy 10. The circuit board 11 is used to acquire the signals from the sensors 30 and to process the signals so that they can be transmitted to a remote monitoring station via a transmitter including an RF circuit integrated in the circuit board 11 and an antenna 13 mounted on the buoy 10. Preferably, the circuit board 11 acquires the signals periodically, e.g., once every minute, and stay in a power-saving mode for the rest of every minute, the circuit board 11. However, if necessary, the circuit board 11 can be actuated to acquire the signals from the sensors 30 by pressing a button (not numbered) formed on the circuit board 11.

A solar panel 14 is mounted on the buoy 10 for converting solar energy into electric energy for powering the circuit board 11, the antenna 13 and the sensors 30.

Figure 2:
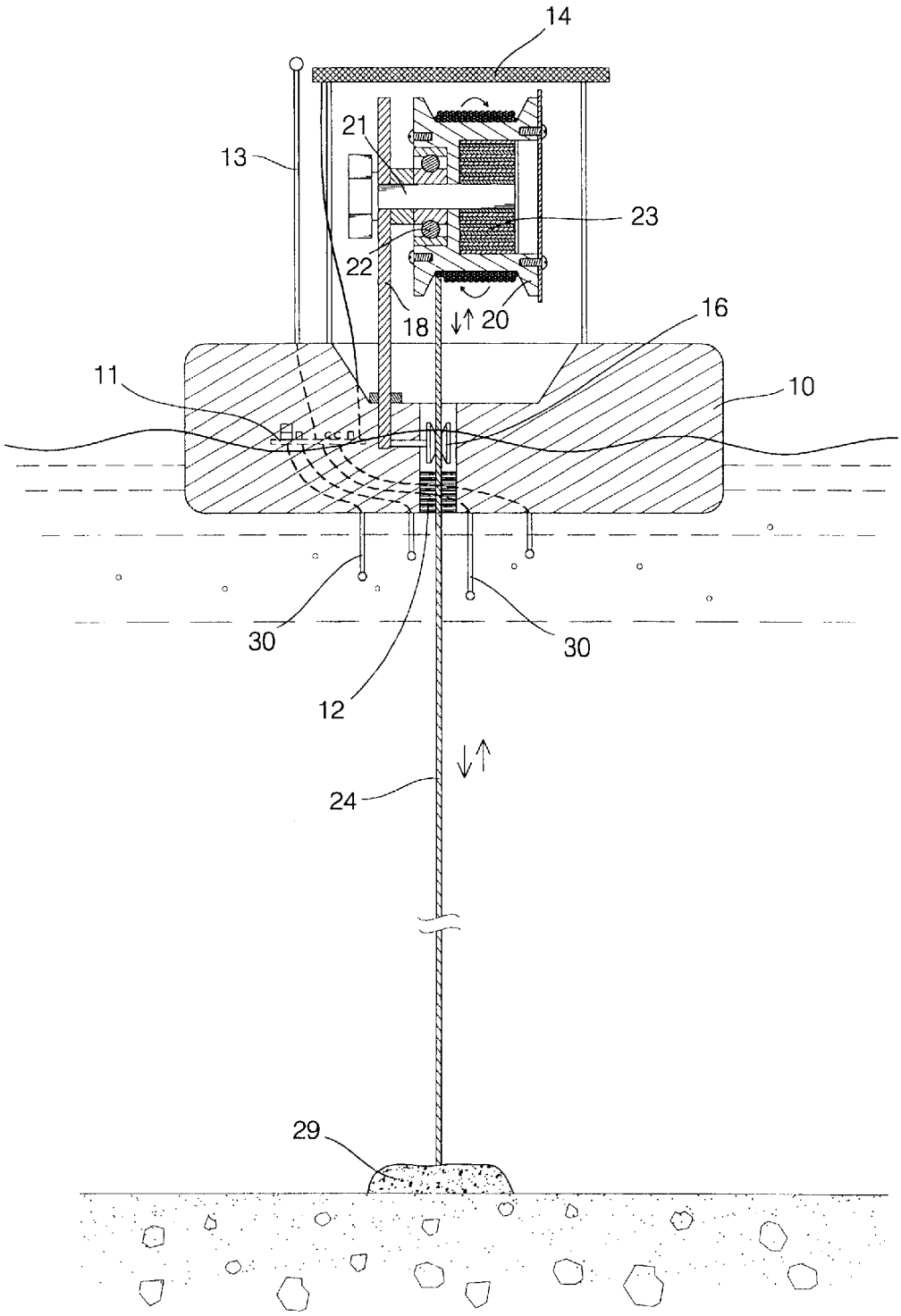
FIG. 2 is a cross-sectional view of the water-monitoring apparatus shown in FIG. 1 taken along a line 2—2.

Referring to FIG. 2, the water-monitoring apparatus includes a plate 18 secured to the buoy 10 for supporting other components (to be described) thereof. A shaft 21 is mounted on the plate 18. A reel 20 is mounted on a middle section of the shaft 21 via a bearing 22 so that the reel 20 is allowed to rotate with respect to the shaft 21. The reel 20 includes a cylindrical body and two flanges each formed at an end of the cylindrical body.

A coil spring 23 is connected between the shaft 21 and the reel 20. The coil spring 23 includes a first end and a second end. The first end of the coil spring 23 is attached to the shaft 21 and the second end of the coil spring 23 is attached to the reel 20. Thus, the coil spring 23 can exert a torque on the reel 20. The coil spring 23 is selected so that when deformed within a certain range it provides a substantially constant torque to the reel 20.

A tension cable 24 is wound on the reel 20. The tension cable 24 includes an upper end and a lower end. The upper end of the tension cable 24 is tied to the reel 20. The lower end of the tension cable 24 is tied to an anchor 29.

In use, the buoy 10 is deployed on the water surface so that each sensor 30 is at least partly immerged in the water for detecting a quality parameter of the water. The buoy 10 is subject to the gravity, a floating force exerted by the water and a tensile force exerted by the tension cable 24. These forces are in a balance.

The tensile force exerted by the tension cable 24 results from the torque exerted on the reel 20 by the coil spring 23. As mentioned, when deformed within a range, the coil spring 23 exerts a substantially constant torque on the reel 20. Thus, when the length of the tension cable 24 extending from the reel 20 changes within a range, the tension cable 24 exerts a substantially constant tensile force on the buoy 10.

When the water level gets higher, an additional section of the tension cable 24 is released from the reel 20, thus keeping the buoy 10 floating on the water. When the water level gets lower, a section of the tension cable 24 is wound onto the reel 20 due to the tensile force exerted on the buoy 10 by the tension cable 24, thus avoiding the buoy from drifting. In both cases, the tension cable 24 tends to exert a substantially constant tensile force on the buoy 10. Since the tensile force and the gravity exerted on the buoy 10 remain the same, the floating exerted on the buoy 10 remains the same, i.e., a substantially constant volume of the buoy 10 is immerged in the water. Thus, each sensor 30 is immerged in the water at a substantially constant depth.

Figure 3:
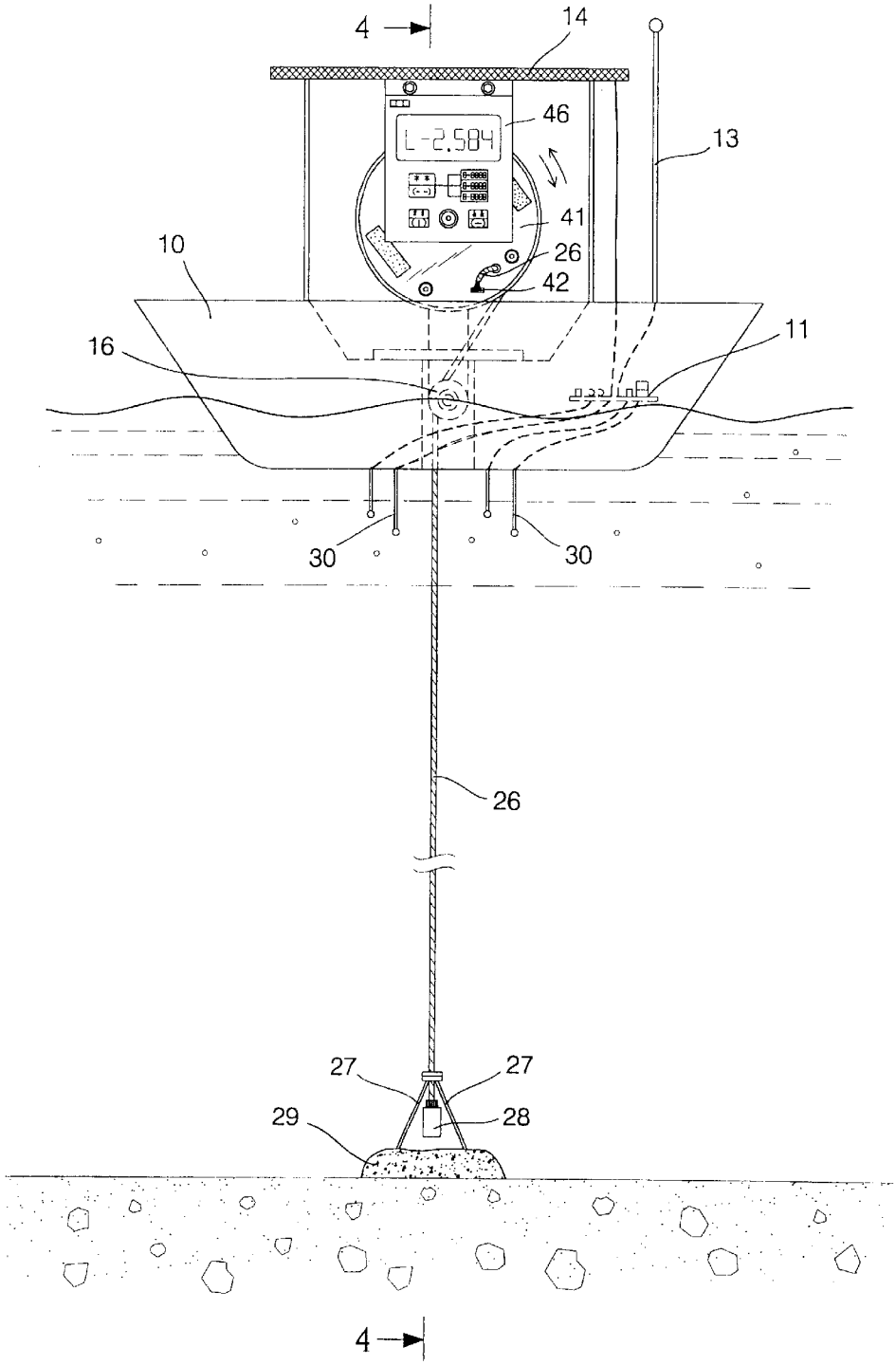
FIG. 3 is a front view of a water-monitoring apparatus in accordance with a second embodiment of the present invention.
Figure 4:
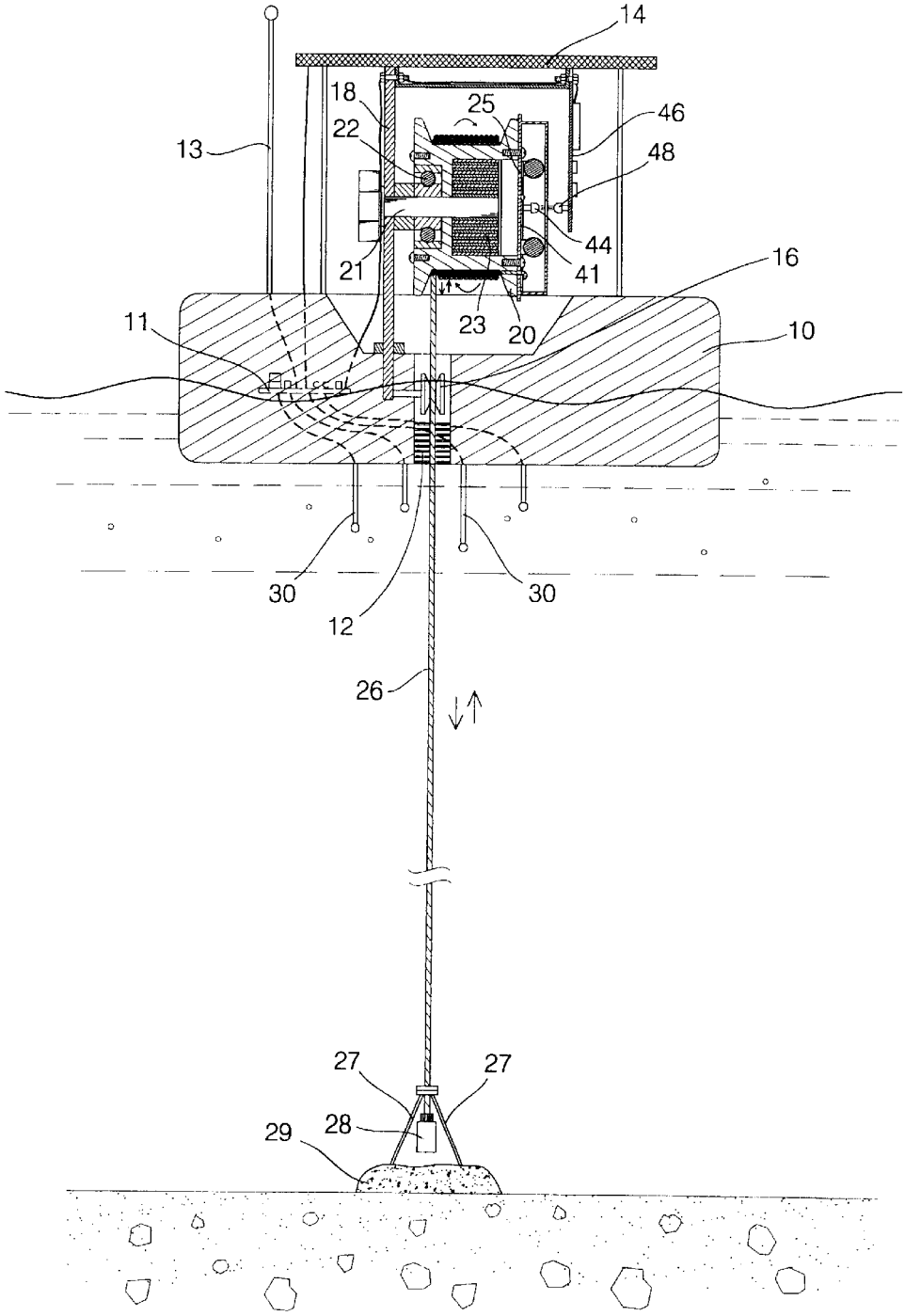
FIG. 4 is a cross-sectional view of the water-monitoring apparatus shown in FIG. 1 taken along a line 4—4.

FIGS. 3 and 4 show a water-monitoring apparatus according to a second embodiment of the present invention. In addition to the functions provided by means of the first embodiment, the second embodiment is capable of detecting a water quality parameter at a predetermined distance from a bottom of the water. To this end, a sensor 28 is located near the anchor 29. The sensor 28 is used to detect a water quality parameter and to produce a signal representative of the water quality parameter. The tension cable 24 of the first embodiment is replaced with a tension and signal cable 26 in the second embodiment. The tension and signal cable 26 is connected with the sensor 28 at a lower end. The tension and signal cable 26 is linked via several tension cables 27 to the anchor 29. Like the tension cable 24, the tension and signal cable 26 is wound on the reel 20. An upper end of the tension and signal cable 26 is inserted through a hole (not numbered) defined in one of the flanges of the reel 20. The upper end of the tension and signal cable 26 is connected with a signal relay (to be described in detail). The signal relay is electrically connected with the antenna 13.

The signal relay is a non-contact signal relay. The signal relay includes a circuit board 41 mounted on a flange of the reel 20. A battery (not numbered) is installed on the circuit board 41. A connector 42 is formed on the circuit board 41 for engagement with the upper end of the tension and signal cable 26. Thus, the signals can be transmitted to the circuit board 41. A light emitter 44 is also formed on the circuit board 41. The signals are processed by means of the circuit board 41 so that they can be emitted by means of the light emitter 44. The signals are received by means of a light receiver 48 installed on a circuit board 46 mounted on the buoy 10. The circuit board 46 is further connected with the circuit board 11.

The present invention has been described in relation to several embodiments. It is obvious that modifications and variations can be derived from these embodiments by those skilled in the art. For example, the circuit board 11 and the circuit board 46 can be merged into a circuit board. The embodiments are described with reference to the drawings for illustrative purposes only and are not intended to limit the scope of the present invention that can only be limited by the attached claims.

What is claimed is:

1. A water-monitoring apparatus comprising:

an anchor (29) for holding on to a bottom under the water;

a buoy (10) for floating on the water surface;

a reel (20) being mounted on the buoy (10);

a tension cable (24) including a lower end tied to the anchor (29) and an upper end tied to the reel (20), the tension cable (24) being wound on the reel (20);

a control device being connected with the reel (20) wherein when the water level changes, the control device rotates the reel (20), thus adjusting a length of the tension cable (24) extending from the reel (20) so that the buoy (10) always floats on the water surface;

at least one sensor (30) being carried via the buoy (10) for detecting at least one environmental characteristic and for producing at least one signal representative of the at least one environmental characteristic; and a transmitter for transmitting the at least one signal to a monitoring station.

2. The water-monitoring apparatus of claim 1 wherein the control device is a coil spring (23) for exerting a constant torque on the reel (20).

3. The water-monitoring apparatus of claim 1 comprising a plate (18) secured to the buoy (10) and a shaft (21)

mounted on the plate (18) wherein the reel (20) is mounted on the shaft (21).

4. The water-monitoring apparatus of claim 3 wherein the control device is a coil spring (23) including a first end attached to the shaft (21) and a second end attached to the reel (20).

5. The water-monitoring apparatus of claim 1 including a circuit board (11) electrically connected with both the at least one sensor (30) and the transmitter.

6. The water-monitoring apparatus of claim 5 wherein the circuit board (11) periodically acquires the at least one signal from the at least one sensor (30) and stays in a power-saving mode for the rest of the time.

7. The water-monitoring apparatus of claim 1 wherein the transmitter includes an antenna (13).

8. A water-monitoring apparatus comprising:

an anchor (29) for holding on to a bottom of the water;

a buoy (10) for floating on the water surface;

a reel (20) being mounted on the buoy (10);

a tension and signal cable (26) including a lower end tied to the anchor (29) and an upper end tied to the reel (20), the tension and signal cable (26) being wound on the reel (20);

a control device being connected with the reel (20) wherein when the water level changes, the control device rotates the reel (20), thus adjusting a length of the tension and signal cable (26) extending from the reel (20) so that the buoy (10) always float on the water surface;

a sensor (28) being connected with the lower end of the tension and signal cable (26) for detecting an environmental characteristic and for producing a signal representative of the environmental characteristic;

a signal relay being electrically connected with the upper end of the tension and signal cable (26); and a transmitter for transmitting the signal to a remote monitoring station.

9. The water-monitoring apparatus of claim 8 wherein the control device is a coil spring (23) for exerting a constant torque on the reel (20).

10. The water-monitoring apparatus of claim 8 comprising a plate (18) secured to the buoy (10) and a shaft (21) mounted on the plate (18) wherein the reel (20) is mounted on the shaft (21).

11. The water-monitoring apparatus of claim 10 wherein the control device is a coil spring (23) including a first end attached to the shaft (21) and a second end attached to the reel (20).

12. The water-monitoring apparatus of claim 8 wherein the signal relay is a non-contact signal relay.

13. The water-monitoring apparatus of claim 12 wherein the non-contact signal relay comprises first and second blocks electrically connected with each other in a non-contact manner.

14. The water-monitoring apparatus of claim 13 wherein the first block is electrically connected with the upper end of the tension and signal cable (26) and the second block is electrically connected with the transmitter.

15. The water-monitoring apparatus of claim 14 wherein the first block includes an emitter (44) for transmitting the signal and the second block includes a receiver (48) for receiving the signal.

16. The water-monitoring apparatus of claim 15 wherein the first block includes a first circuit board (41) connected with the upper end of the tension and signal cable (26), the emitter (44) being installed on the first circuit board (41).

17. The water-monitoring apparatus of claim 15 wherein the second block includes a second circuit board (46) electrically connected with the transmitter, the receiver (48) being installed on the second circuit board (46) for receiving the signal.

18. The water-monitoring apparatus of claim 17 wherein the emitter (44) is a light emitter and the receiver (48) is a light receiver.

19. The water-monitoring apparatus of claim 16 wherein the signal relay comprises a connector (42) formed on the first circuit board (41) for electric engagement with the upper end of the tension and signal cable (26).

20. A water-monitoring apparatus comprising:

an anchor (29) for holding on to a bottom of the water;

a buoy (10) for floating on the water surface;

a reel (20) being mounted on the buoy (10);

a tension and signal cable (26) including a lower end tied to the anchor (29) and an upper end tied to the reel (20), the tension and signal cable (26) being wound on the reel (20);

a control device being connected with the reel (20) wherein when the water level changes, the control device rotates the reel (20), thus adjusting a length of the tension and signal cable (26) extending from the reel (20) so that the buoy (10) always float on the water surface;

a shallow-water sensor (30) being carried via the buoy (10) for detecting a first environmental characteristic and for producing a first signal representative of the first environmental characteristic;

a deep-water sensor (28) being connected with the lower end of the tension and signal cable (26) for detecting a second environmental characteristic and for producing a second signal representative of the second environmental characteristic;

a signal relay being electrically connected with the upper end of the tension and signal cable (26); and a transmitter for transmitting the first and second signals to a remote monitoring station.

* * * * *